United States Patent [19]

Peppler

[11] Patent Number: 4,498,715

[45] Date of Patent: Feb. 12, 1985

[54] CABLE SHIELD GROUNDING CLAMP

[75] Inventor: Michael S. Peppler, Lancaster, Pa.

[73] Assignee: AMP Incorporated, Harrisburg, Pa.

[21] Appl. No.: 480,041

[22] Filed: Mar. 29, 1983

[51] Int. Cl.[3] ..... H01R 4/24; H01R 4/66

[52] U.S. Cl. ..... 339/14 R; 339/17 F; 339/97 P

[58] Field of Search ..... 339/14 R, 6, 143 R, 339/128, 17 F, 97 P, 97 C

[56] References Cited

U.S. PATENT DOCUMENTS

| | | | |
|---|---|---|---|
| 2,774,951 | 12/1956 | Kinkaid . | |
| 3,541,226 | 11/1970 | Cea et al. . | |
| 3,541,227 | 11/1970 | Bendrick . | |
| 3,706,121 | 12/1972 | Gillespie . | |
| 3,934,075 | 1/1976 | Dilliplane | 339/97 C X |
| 4,241,970 | 12/1980 | Rider et al. . | |
| 4,263,474 | 4/1981 | Tennant | 339/97 C X |
| 4,420,201 | 12/1983 | Stephenson | 339/14 R |
| 4,422,700 | 12/1983 | Krenz | 339/14 R |

*Primary Examiner*—Eugene F. Desmond

*Attorney, Agent, or Firm*—Russell J. Egan

[57] ABSTRACT

A clamp is disclosed for securing shielding of a shielded cable to the periphery of an aperture in a panel, through which the cable passes, thereby providing an RF/EMI shielded entry through the panel. The clamp includes a central aperture through which the cable passes and a pair of lateral flanges which, when folded upon themselves, secure portions of the cable shielding and cable insulation thereby providing both a ground path and strain relief for the cable. The clamp can be mounted on either surface of a panel and entirely encloses the opening therein.

12 Claims, 4 Drawing Figures

CABLE SHIELD GROUNDING CLAMP

The present invention relates to means to clamp shielding of a shielded cable to edges of an opening in a panel or the like, through which the cable passes, thereby providing total shielding of the opening, grounding of the shielding and strain relief for the cable.

The increased use of electronic equipment has caused a corresponding rise in the amount of radio frequency and electro-magnetic interference being generated. It is necessary to prevent both RF/EMI from entering into equipment or to be contained therein in order to preserve the electronic integrity of an electronic system. There have also been recent numbers of federal regulations which greatly restrict the amount of RF/EMI that can be tolerated.

While it is possible to contain RF/EMI within a component or cabinet it is often necessary to interconnect with various peripheral equipment and thus the barrier formed by the casing or equipment housing must be perforated thereby creating the possibility of allowing the escape of or entrance of RF/EMI. In either case, if there is an unprotected opening, this can create a slot antenna which can have very derogatory effects on adjacent equipment.

The present invention overcomes the above described difficulty by providing a clamp which engages the insulation and shielding of a shielded multi-conductor cable to provide both strain relief for the cable and grounding of the shields while mounting the cable on a panel, bulkhead or the like, so that the clamp overlies and covers a cable passage aperture therein. The clamp is an elongated metal body with a central opening through which the cable passes and a pair of integral lateral flanges opposite the opening. The flanges and the body portions between the opening and the flanges are each provided with a plurality of apertures and lances which, when the flanges are folded upon the adjacent body portion, penetrate the shielding and insulation of the cable to secure them to the clamp. The clamp further includes a slot extending from one end of the central opening and means for mounting the clamp on either face of a panel, bulkhead, or the like overlying a cable passage aperture therein.

An embodiment of the present invention will now be described by way of example with reference to the accompanying drawings in which.

Figure 1:
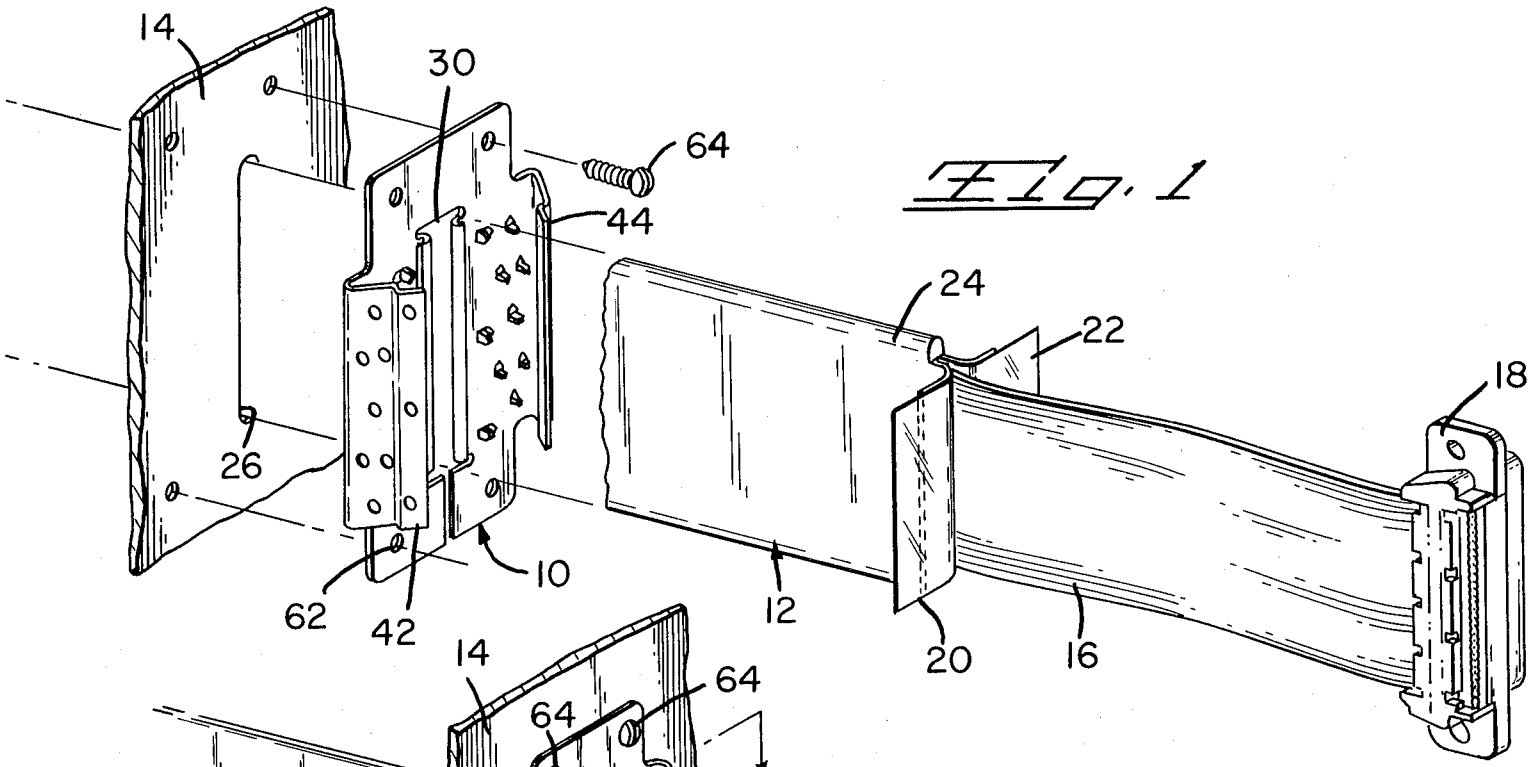
FIG. 1 is an exploded perspective view of the subject invention together with a cable, connector, and panel.

The clamp 10 of the subject invention is used to secure a shielded, multi-conductor cable 12 to a panel, bulkhead, or the like 14. The cable 12 is of the type having a central ribbon 16 formed by a plurality of individual insulated conductors which are shown terminated by a known electrical connector 18. The connector illustrates is of the type shown in U.S. Pat. No. 4,241,970, the disclosure of which is incorporated herein by reference. The cable further includes shielding layers 20, 22 and an outer jacket or sheath 24. The shielding layers can be either a conductive foil or a metal mesh. Preferably, for ease of handling, the cable is of the type in which the shielding layers 20, 22 are merely placed on both sides of the ribbon of conductors 16 and the insulative sheath 24 encloses the shielding layers but is not adhered hereto.

The panel bulkhead or the like, 14 is a conductive wall of an equipment housing having an elongated cable passage aperture 26 therein. It is the intent of the present invention to join the shielding 20, 22 of the cable 12 to the panel 14 leaving enough free length of conductor ribbon 16 to allow the connector 18 to mate with an appropriate connector (not shown) inside the housing. The subject clamp 10 can be mounted on either the inner or outer face of the panel 14 without departing from the spirit or essential characteristics of the invention. It may be that an interior mounting as shown, would have some preference from the asthetic standpoint of keeping the outside of the cabinet relatively clean in appearance.

Figure 2:
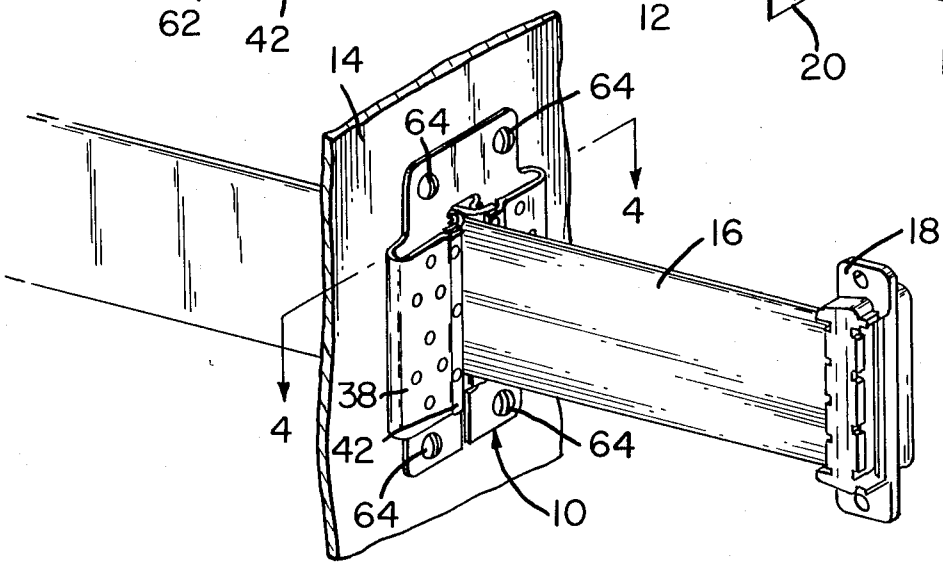
FIG. 2 is a view similar to FIG. 1 showing the clamp in a fully assembled condition.
Figure 4:
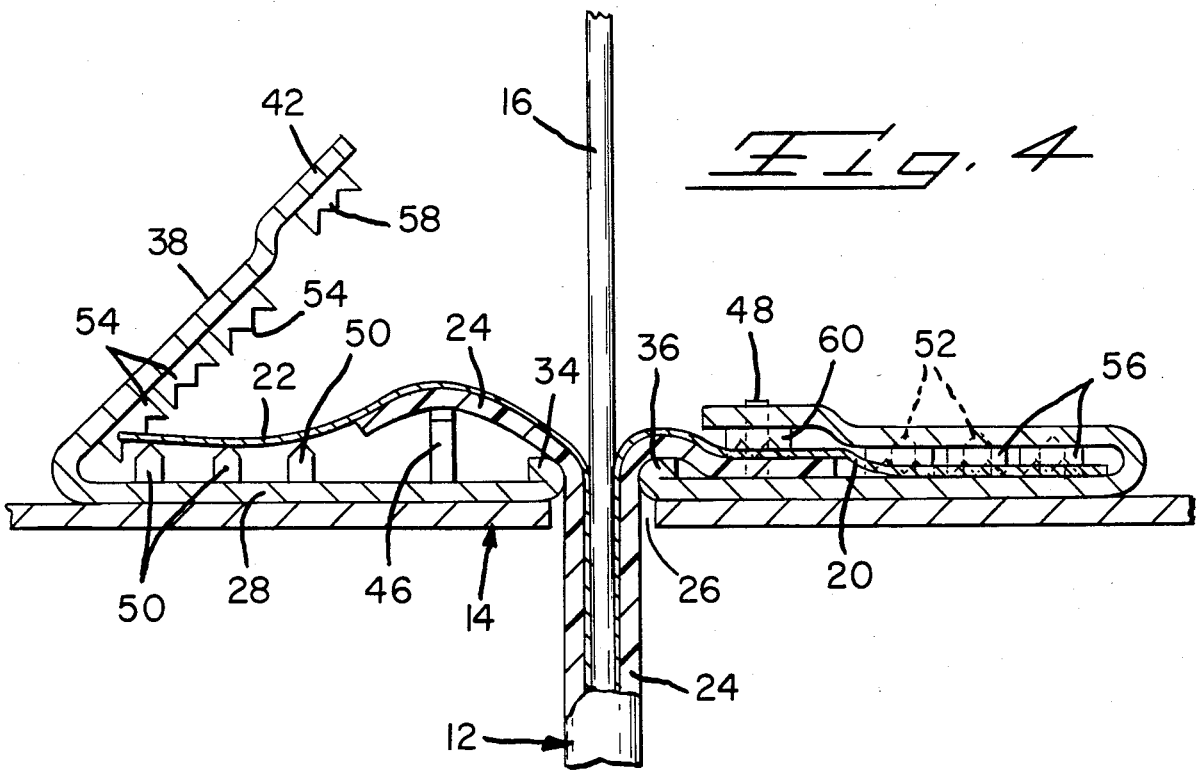
FIG. 4 is a transverse section taken along line 4—4 of FIG. 2.

The subject clamp 10 is formed from a piece of copper, or other conductive material, and has an elongated body 28 with a similar elongated central cable passage 30 with a slot 32 connecting the passage 30 to one marginal edge of the body 28. Flange portions 34, 36 adjacent each elongated edge of passage 30 are rolled back upon the body 28 to form a smooth entry. First and second integral flanges 38, 40 extend from opposite edges of the body 28 and are aligned with the passage 30. Each flange has a stepped portion 42, 44, respectively, at its free end. The clamp 10 is provided with groups of lances or tines and corresponding apertures which are arranged, starting from each side of the passage 30 and working toward the free ends of the flanges, first insulation piercing lances 46, 48, second shield piercing lances 50, 52 second shield apertures 54, 56 and first insulation apertures 58, 60. Each aperture 54, 56, 58, 60 is surrounded by tines which project from the same plane of the clamp 10 as the lances and is aligned with a respective lance when the flanges are folded upon themselves, as shown in FIGS. 2 and 4. The tines of the apertures 54, 56 interengage with lances 50, 52 to trap the shielding 20, 22 therebetween. The tines of the apertures 58, 60 interengage with lances 46, 48 to trap the insulation 24 therebetween. It will be appreciated that the lances 46, 48 and apertures 58, 60 will be larger in size and fewer in number than lances 50, 52 and apertures 54, 56.

In the closed position of the flanges 38, 40, 42, 44 the lances 46, 48, 50, 52 will penetrate the shielding 20, 22 and insulation 24 of the cable 12 to perform both a grounding and strain relief function. The clamp 10 is completed by a plurality of mounting holes 62 each of which receives an appropriate mounting means 64 to secure the clamp to the panel 14.

The present invention is employed by first stripping the insulation 24 from an end portion of a shielded cable 12, as shown in FIG. 1, to reveal the ribbon of conductors 16 and the shielding layers 20, 22. The cable 12 can either be terminated by connector 18 now or later, after the clamp, is put in place. If the connector 18 is placed on the cable, then the cable can be slipped through the slot 32 into proper position in the clamp, otherwise the cable can just be fed through the central passage 30. Once the cable is in position, the flanges 38, 40 of the clamp are secured to the respective sides of the cable to engage the shielding 20, 22 and the insulation 24 as best seen in the section view of FIG. 4. The clamping can be effected by any known tool, such as the one shown in U.S. Pat. No. 3,706,121, the disclosure of which is incorporated herein by reference. Once the termination is effected the clamp can be secured to the panel by means of the fasteners 64.

Figure 3:
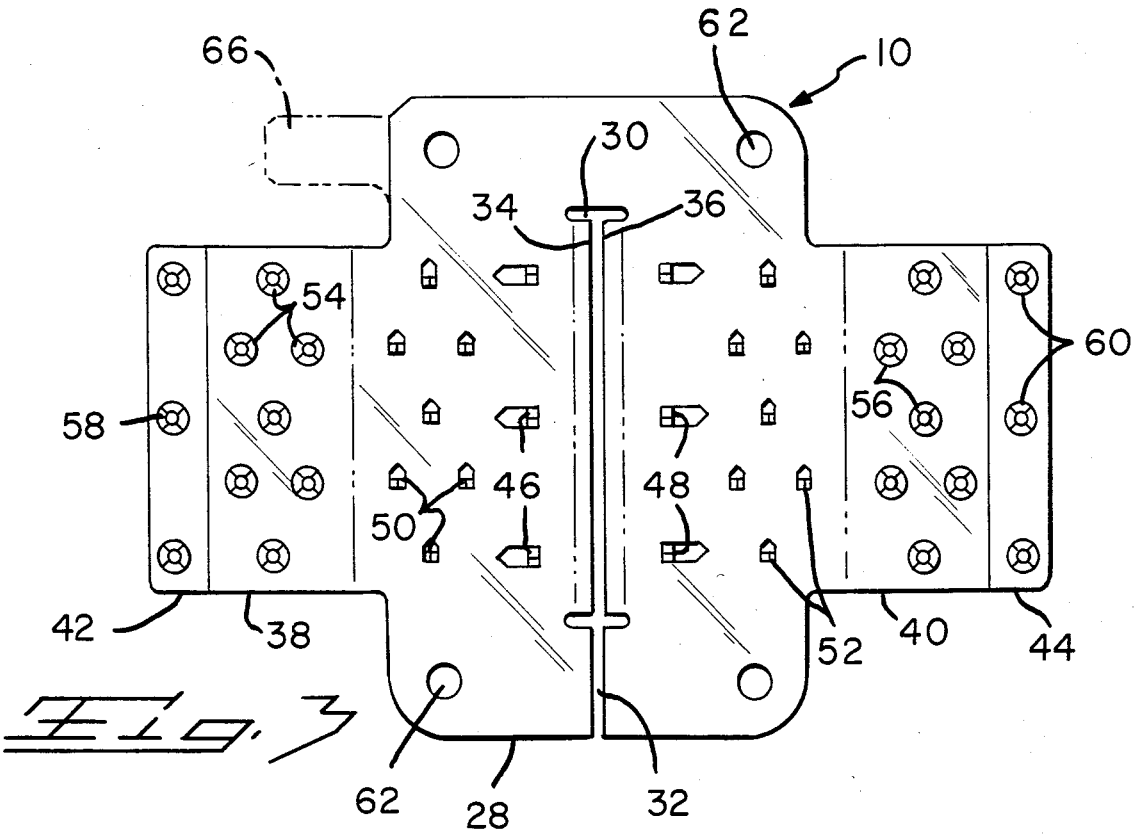
FIG. 3 is a plan view of the subject clamp.

It would also be possible to form the subject clamp 10 with a flange or tab 66, see FIG. 3, which could be used to receive a terminal, (not shown) such as described in U.S. Pat. No. 2,774,951, to provide additional grounding.

I claim:

1. A clamp for securing a shielded cable to a panel, said panel having an aperture through which a cable passes and said cable having a plurality of insulated conductors enclosed within conductive shielding and an outer insulative sheath, said clamp comprising a conductive body having a central passage through which the cable extends and a pair of integral lateral flanges aligned with said central passage, a rolled edge formed on each elongated side of said passage to protect the cable, a plurality of lances and corresponding apertures formed in said clamp body and said flanges, each aperture surrounded by a plurality of tines, all said tines and said lances extending from a single face of said clamp, and means to mount said clamp on said panel whereby the insulation and shielding of said cable are secured by folding said flanges upon said body crimpingly engaging the shielding and insulation with said lances and said tines.

2. The clamp according to claim 1 further comprising a slot extending from one end of said passage to an outside edge of said clamp body whereby a terminated cable can be slipped into place in said passage.

3. The clamp according to claim 1 wherein said apertures at the free end of said flanges and said lances adjacent said passage are larger and fewer in number whereby the insulation of said cable is more readily penetrated.

4. A clamp for securing a shielded cable to an aperture in a panel, bulkhead, or the like, the cable having a plurality of insulated conductors in flat ribbon form surrounded by at least one layer of conductive shielding and enclosed within an insulative sheath, said cable having a connector terminating the respective conductors and the clamp being formed of conductive material having an elongated central cable passage characterized by a rolled edge formed on each elongated side of said central cable passage to protect said cable from damage and a pair of lateral elongate integral flanges which, when folded upon themselves, engage and trap respective portions of the cable shielding and insulative sheath thereby securing the cable and being mounted against said panel forming an RF/EMI shield therefor.

5. A clamp for securing shielding and insulation of a shielded cable passing through an opening in a panel, bulkhead, or the like to said panel so as to provide both grounding of said shielding and strain relief for said cable, said clamp comprising;

an elongated metal body having an elongated central passage and a pair of integral flanges extending from opposite sides of said body aligned with said passage and with the axes of said flanges lying normal to the axis of said passage, end portions of each flange being stepped to accommodate the additional thickness of the cable insulation;

a plurality of lances formed in said body between said passage and the adjacent flange; and a like plurality of apertures formed in each said flange, each aperture being associated with a respective lance, whereby folding said flanges upon themselves and said body causes said lances to pierce the shielding and insulation of said cable and engage a respective aperture gripping said cable therebetween.

6. A clamp according to claim 5 wherein said lances and said apertures are each formed in first and second groups, said first group of lances being adjacent said passage and said first group of apertures being adjacent the free ends of the respective flanges, said first group of lances and apertures being larger than and fewer in number than said second group in order to accommodate the additional thickness of the cable insulation.

7. A clamp according to claim 5 further comprising:

a rolled edge formed on each elongated side of said passage forming a smooth surface of transition whereby said cable is protected from damage.

8. A clamp according to claim 5 further comprising:

means to mount said clamp on said panel.

9. A clamp according to claim 5 further comprising:

a tab integral with said clamp whereby additional grounding means can be applied thereto.

10. A clamp according to claim 5 further comprising:

a slot in said body extending between one end of said passage and an adjacent marginal edge of said clamp whereby a pre-terminated cable can be shipped sidewise into said clamp.

11. A clamp according to claim 5 wherein each said aperture is formed with a plurality of tines about the periphery thereof, each said tine also engaging and gripping said cable.

12. A clamp according to claim 12 wherein said lances and said tines all extend from the same surface of said clamp.

* * * * *